United States Patent [19]

Moriya et al.

[11] Patent Number: 4,546,736

[45] Date of Patent: Oct. 15, 1985

[54] FUEL SUPPLY CONTROL SYSTEM

[75] Inventors: Kouichi Moriya; Kouki Iwata; Hideyasu Takefuta, all of Higashimatsuyama, Japan

[73] Assignee: Diesel Kiki Co., Ltd., Tokyo, Japan

[21] Appl. No.: 585,587

[22] Filed: Mar. 2, 1984

[30] Foreign Application Priority Data

Mar. 4, 1983 [JP] Japan ..... 58-034401

[51] Int. Cl.[4] ..... F02N 17/00; F02B 3/00; F02D 11/10; F02D 1/04

[52] U.S. Cl. ..... 123/179 G; 123/438; 123/179 A; 123/491

[58] Field of Search ..... 123/339, 438, 399, 480, 123/440, 489, 585, 586, 491, 179 A, 179 B, 179 G

[56] References Cited

U.S. PATENT DOCUMENTS

| | | | |
|---|---|---|---|
| 4,237,833 | 12/1980 | Desbauriers | 123/339 |
| 4,344,392 | 8/1982 | Ijima et al. | 123/179 G |
| 4,383,506 | 5/1983 | Nago et al. | 123/179 G |
| 4,392,471 | 7/1983 | Miyagi et al. | 123/438 |
| 4,419,973 | 12/1983 | Collonia | 123/399 |
| 4,424,785 | 6/1984 | Ishida et al. | 123/399 |
| 4,440,128 | 4/1984 | Nakano et al. | 123/339 |
| 4,452,200 | 6/1984 | Tsutsumi et al. | 123/339 |
| 4,453,516 | 6/1984 | Filsinger | 123/399 |
| 4,466,392 | 8/1984 | Uchida et al. | 123/179 G |
| 4,480,618 | 11/1984 | Kamifuji et al. | 123/179 G |

*Primary Examiner*—Raymond A. Nelli

*Attorney, Agent, or Firm*—Wenderoth, Lind & Ponack

[57] ABSTRACT

A fuel supply control system for an internal combustion engine has first and second step motor drivers for driving a step motor operatively coupled to a fuel supply control means such as a throttle valve. An initial step position setting memory stores an initial preset step position of the step motor, and a target step memory stores a target step position of the step motor dependent on an accelerator pedal position. A driver selector selects the first step motor driver for driving the step motor to the initial preset step position in response to a signal from a power-on detector, and selects the second step motor driver for driving the step motor to the target step position in response to a signal from an engine self-operation detector.

3 Claims, 9 Drawing Figures

FUEL SUPPLY CONTROL SYSTEM

BACKGROUND OF THE INVENTION

The present invention relates to a fuel supply control system for controlling the amount of fuel supplied to an internal combustion engine, and more particularly to a fuel supply control system in which a fuel supply control means is driven by a step motor.

Fuel supply control means such as throttle valves in spark ignition engines and control levers in diesel engines have conventionally been driven by a step motor which is energized to a step position corresponding to a position to which an accelerator pedal is depressed for thereby effecting fuel supply control.

When the starter motor is energized to start the internal comubustion engine, the voltage of a main power supply is lowered, therey casusing the voltage applied to an excitation circuit of the step motor to drop. This is disadvantageous in that the step motor cannot be rotated to a step position commensurate with a position to which the accelerator pedal is depressed when the engine is started.

SUMMARY OF THE INVENTION

With the foregoing drawback in view, it is an object of the present invention to provide a fuel supply control system for use in an internal combustion engine, in which a step motor is driven to an initial position setting to cause a fuel supply control means to supply a predetermined amount of fuel at the time the engine is started, and thereafter the step motor is driven to a step position corresponding to a position to which an accelerator pedal is depressed after the internal combustion engine has been detected as operating by itself without the aid of a starter.

According to the present invention, there is provided a fuel supply control system for controlling an amount of fuel supplied to an internal combustion engine by driving a step motor operatively coupled to fuel supply control means of the engine, the fuel supply control system comprising a power-on detector means for detecting when a main power supply voltage is applied, an engine self-operation detector means for detecting when the engine is operating by itself, an accelerator-pedal position detector means for detecting a position to which an accelerator pedal is depressed, an initial step position setting memory means for storing an initial preset step position for the step motor, a target step position memory means for storing a target step position for the step motor corresponding to said position to which the accelerator pedal is depressed, a first step motor driver means for driving the step motor stepwise to the initial preset step position stored in said initial step position setting memory means, a second step motor driver means for driving the step motor stepwise to the target step position stored in said target step position memory means, and a selector means for selecting said first step motor driver means in response to a signal from said power-on detector means and for selecting said second step motor driver means in response to a signal from said engine self-operation detector means. The fuel supply control system may also includes a voltage detector means for detecting the value of the main power supply voltage, and a starter operation detector means for detecting operation of a starter for starting the engine.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Throughout the embodiments of the present invention, a step motor for actuating a fuel supply control means such as a throttle valve, for example, is shown and described as comprising a four-phase step motor drivable for rotation with two phases excited at a time.

The present invention is applicable generally to internal combustion engines such for example as spark ignition engines and diesel engines.

Figure 1:
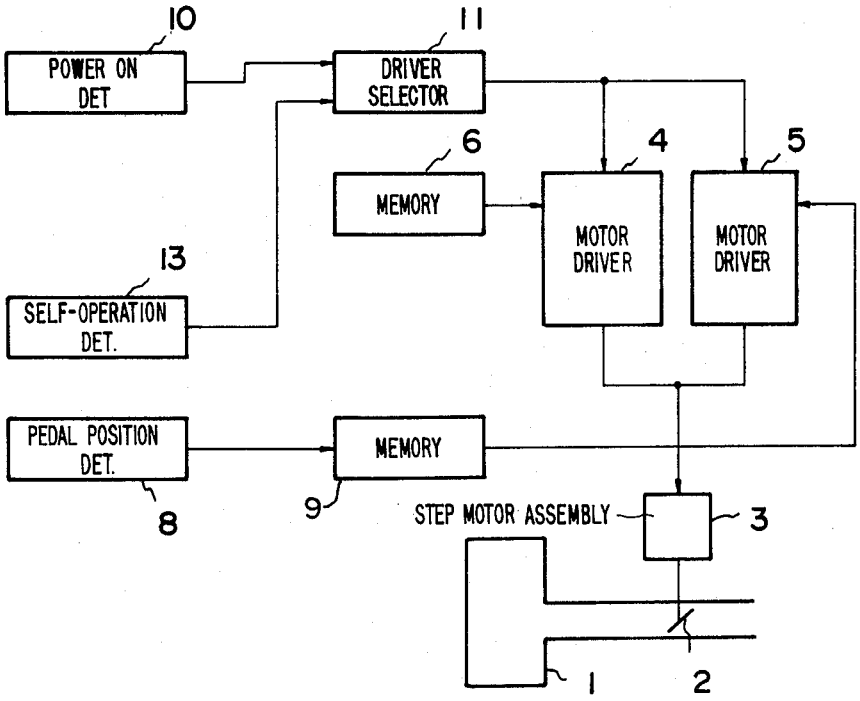
FIG. 1 is a block diagram of a fuel supply control system according to a first embodiment of the present invention.

FIG. 1 shows a fuel supply control system according to a first embodiment of the present invention for controlling fuel supply to a spark ignition engine 1 such as a gasoline engine.

The spark ignition engine 1 has a throttle valve 2 actuatable to provide desired valve openings for controlling the amount of an air-fuel mixture supplied into engine cylinders. The throttle valve 2 is operatively coupled to a step motor assembly 3 drivable in steps by two-phase excitation pulses output from a motor driver 4 or 5 and amplified by an exciting circuit.

The step motor assembly 3 has a rotor (not shown) angularly movable to incremental steps corresponding respectively to successive openings of the throttle valve 2.

The voltage value of a main power supply voltage is detected by a power-on detector 10 and the voltage is supplied as a power supply voltage to the exciting circuit. In response to detection of the main power supply voltage, a predetermined initial position setting is stored in an initial position setting memory 6, and the motor driver 4 is selected by a driver selector 11 so as to cause the step motor assembly 3 to be driven stepwise to the initial position setting (hereinafter also referred to as the stored content) stored in the initial position setting memory 6. Therefore, the throttle valve 2 is driven to an opening corresponding to the stored content of the initial position setting memory 6. After the main power supply voltage has been supplied, an engine starter (not shown) is actuated to put the engine 1 into operation. When the engine 1 is operated by itself without the aid of the starter, an engine self-operation detector 13 detects such a condition and causes the driver selector 11 to select the motor driver 5.

A position to which an accelerator pedal is depressed is detected by an accelerator pedal position detector 8, and a target step position for the step motor assembly 3 which corresponds to the detected accelerator pedal position is stored in a target position memory 9. The target step position (hereinafter also referred to as stored content) stored in the target position memory 9 will be renewed each time the accelerator pedal position is changed.

When the motor driver 5 is selected by the driver selector 11 in response to detection of a self-operation condition of the engine 1, the step motor assembly 3 is driven stepwise by the motor driver 5 to the target step position stored in the target position memory 9. Accordingly, while the engine 1 is operating by itself, the throttle valve 2 is controlled so as to be actuated to the opening commensurate with the accelerator pedal position for fuel supply control.

Figure 2:
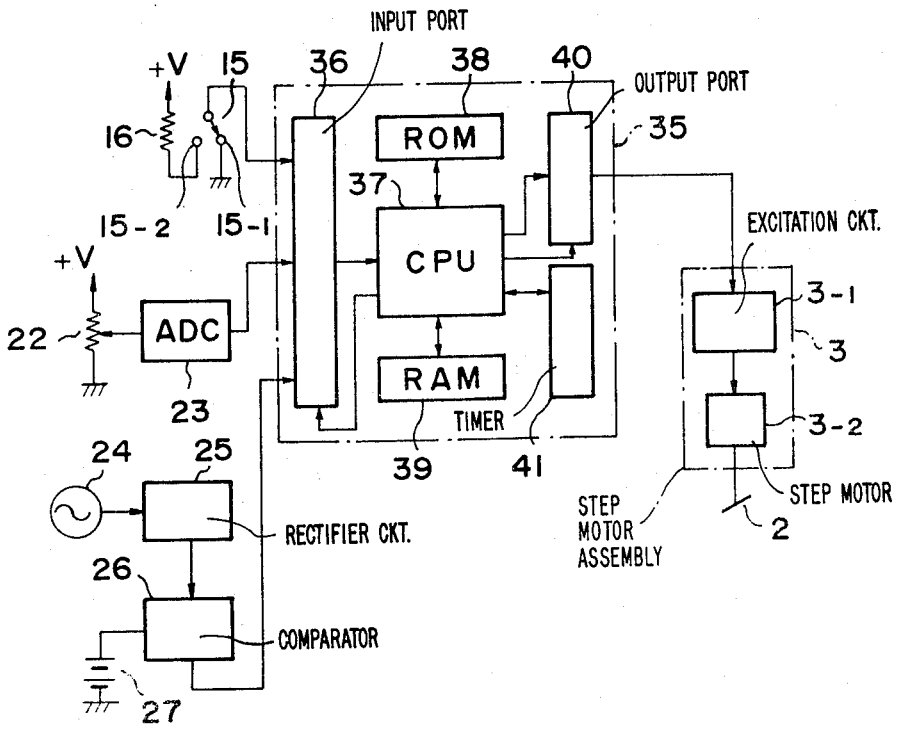
FIG. 2 is a block diagram showing a microcomputer and input and output devices which implement the fuel supply control system of the first embodiment.

FIG. 2 shows a microcomputer and input and output devices by which the fuel supply control system of the first embodiment is implemented.

The microcomputer, which is generally designated by 35 and of a known construction, is basically composed of an input port 36, central processing unit (CPU) 37, a read-only memory (ROM) 38, a random-access memory (RAM) 39, an output port 40, and a timer 41 comprising a counter timer controller. The ROM 38 stores a program for controlling the CPU 37 to achieve the functions described with reference to FIG. 1. The microcomputer 35 is functionally equivalent to the motor drivers 4 and 5, the initial position setting memory 6, the target position memory 9, and the driver selector 11 shown in FIG. 1.

A switch 15 is switchable in coaction with a main power supply switch, that is, an ignition switch and has an off-terminal 15-1 and an on-terminal 15-2. The off-terminal 15-1 corresponds to an off-terminal of the ignition switch and is grounded. The on-terminal 15-2 corresponds to an on-terminal of the ignition switch and is supplied with a voltage +V through a pull-up resistor 16. The switch 15 has a movable contact connected to the input port 36. When the ignition switch is turned on to apply the main power supply voltage to electric parts such as an ignitor, the movable contact of the switch 15 supplies a high-potential signal to the input port 36. Thus, the switch 15 serves as the power-on detector 10 shown in FIG. 1.

Figure 3:
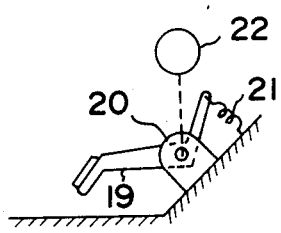
FIG. 3 is a side elevational view of an accelerator pedal.

As illustrated in FIG. 3, an accelerator pedal 19 is pivotally supported by a pivot shaft thereof on a bearing 20 fixed to a stationary base. The accelerator pedal 19 has one end projecting over a vehicle floor near a driver's seat and an opposite end coupled to a coil spring 21 which normally urges the accelerator pedal 19 to turn clockwise about the bearing 20. The pivot shaft of the accelerator pedal 19 is operatively connected to a potentiometer 22 so that the potentiometer 22 can detect a position to which the accelerator pedal 19 is depressed. An output voltage from the potentiometer 22 is converted by an analog-to-digital converter 23 into digital data which is supplied to the input port 36. Accordingly, the potentiometer 22 and the analog-to-digital converter 23 serve as the accelerator pedal position detector 8 illustrated in FIG. 1.

An AC generator 24 is coupled to the crank shaft of the engine 1 (FIG. 1) and supplies an output voltage as divided to a rectifier circuit 25. An rectified voltage from the rectifier circuit 25 is then supplied to a comparator 26 which will detects when the rectified voltage exceeds the voltage supplied from a reference voltage source 27. While the engine 1 is not operating by itself, or is being started by the starter, the output voltage from the AC generator 24 is relatively low, and the rectified voltage from the rectifier circuit 25 is lower than the voltage from the reference voltage source 27. Therefore, the output voltage from the comparator 26 is of a low potential. While the engine 1 is operating by itself, the output voltage from the AC generator 24 is increased to make the rectified voltage from the rectifier circuit 25 higher than the voltage from the reference voltage source 27. Then, the output voltage from the comparator 26 goes high in potential. As a consequence, whether the engine 1 is operating by itself can be detected on the basis of the output potential of the comparator 26. Thus, the AC generator 24, the rectifier circuit 25, the comparator 26, and the reference voltage source jointly serve as the engine self-operation detector 13 shown in FIG. 1.

The input port 36 comprises a multiplexer for selectively supplying the output from the switch 25, the output digital data from the analog-to-digital converter 23, the output from the comparator 26 to the CPU 37 in response to a selection signal issued by the CPU 37 under the control of the program stored in the ROM 38.

The timer 41 comprises a frequency-divider for frequency-dividing a clock signal in the microcomputer 35 and a programmable down counter for counting down the frequency-divided output from the frequency divider. A frequency-division ratio for the frequency divider and a preset value for the programmable down-counter can be set by the program stored in the ROM 38 through the CPU 37. The timer 41 issues an interrupt signal upon passage of a period of time determined by the frequency-division ratio and the preset value.

The CPU 37 processes the inputs read therein, stores the inputs in given areas in the RAM 39, renews the stored contents of the RAM 39, executes a process according to the program stored in the ROM 38 in response to the interrupt signal, and outputs processed outputs through the output port 40 to the step motor assembly 3 according to the program stored in the ROM 38. The step motor assembly 3 is composed of an excitation circuit 3-1 for amplifying the output or excitation pulses from the microcomputer 35 and a step motor 3-2 which is supplied with the excitation pulses which have been amplified by the excitation circuit 3-1.

Figure 4:
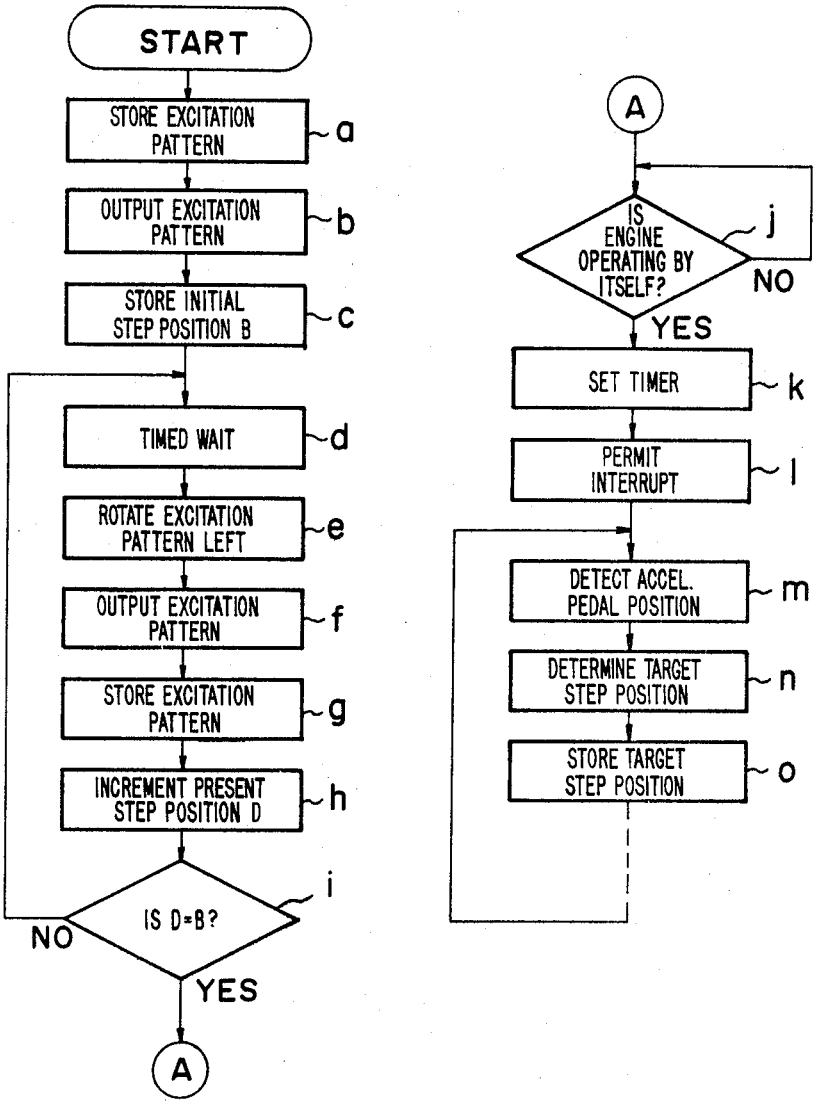
FIGS. 4 and 5 are flowcharts showing operation of the fuel supply control system of the first embodiment.
Figure 5:
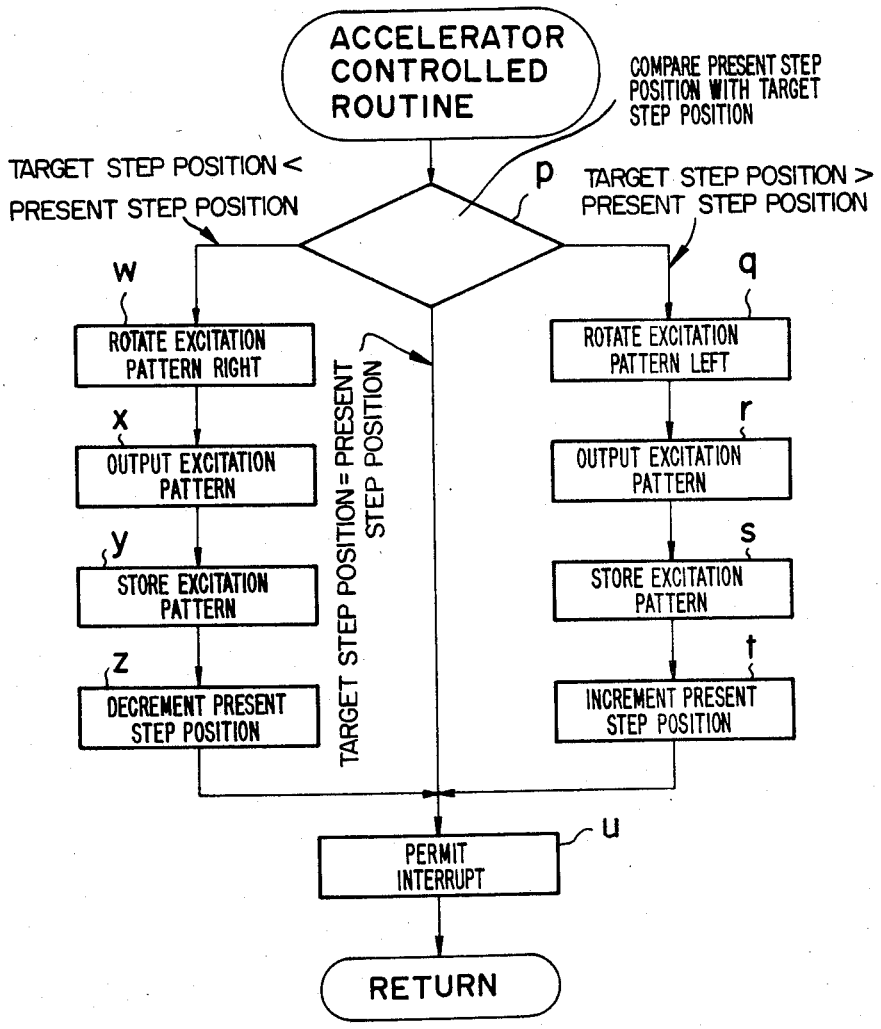

The program stored in the ROM 38 is illustrated in the flowcharts of FIGS. 4 and 5. Operation of the fuel supply control system according to the first embodiment will now be described with reference to FIGS. 4 and 5.

When the switch 15 is turned on, the program starts to be executed. Upon the program execution begins, the microcomputer 35 clears the stored contents of a step motor speed storage area, an initial step position setting storage area, a target step position storage area, and a current step position storage area in the RAM 39, and then stores a bit pattern corresponding to a phase number and an excitation method for the step motor assembly 3 in a given area in the RAM 39 for initializing (program step a). Since the step motor used in this embodiment is a four-phase step motor with two phases excited at a time, the bit pattern comprises an 8-bit pattern of 33(H), for example, ("H" means a hexadecimal notation) and four low-order bits are used for driving the step motor. The four bits used correspond, from LSB, to a, b, c, and d phases of the step motor. When the step motor is excited in the order of . . . a and b phases, b and c phases, c and d phases, d and a phases, . . . , the rotor of the step motor is turned clockwise to open the throttle valve 2. Conversely, when the step motor is excited in the order of . . . a and d phases, d and c phases, c and b phases, b and a phases, . . . , the rotor of the step motor is turned counterclockwise to close the throttle valve 2.

The stored content of the excitation pattern storage area is delivered through the output port 40 to the excitation circuit 3-1, by which the excitation pattern is amplified and supplied to the step motor 3-2 (program step b). In response to execution of the program step b, the a and b phases of the step motor are excited to bring the rotor to a reference step position in which the throttle valve 2 is fully closed. The step motor is then deenergized to stop the rotor in the reference step position. Then, in a program step c, a step motor step position corresponding to a predetermined opening of the throttle valve 2 is stored in the initial step position setting storage area.

After the program step c has been executed, the program waits for a preset interval of time to elapse by means of a software-implemented timer (program step d). Upon elapse of the preset interval of time, the excitation pattern is rotated left by one bit (program step e). The excitation pattern thus rotated left by one bit is delivered through the output port 40 to the step motor assembly 3 (program step f). Since the excitation pattern changes from 33(H) to 66(H) in the program step e, the b and c phases of the step motor 3-2 are now excited to turn the rotor one step clockwise so as to thereby open the throttle valve 2 through an angular interval corresponding to the one-step angular displacement of the step motor rotor. Since the program waits for the preset interval of time to elapse in the program step d, the period from the a and b phase excitation to the b and c phase excitation, or the speed of rotation of the step motor 3-2 is equal to the reciprocal of the preset interval of time the program waits for to elapse in the program step d. Subsequent to the program step f, the excitation pattern (66(H) in this operation mode) is stored in the excitation pattern storage arear (program step g). Then, the program goes to a program step h in which the stored content of the present step position storage area is incremented by 1. Therefore, the present step position storage area stores the present step position of the step motor by renewing the stored content of the present step position storage area. The program step h is followed by a program step i in which the stored content of the present step position storage area is compared with the stored content of the initial step position setting area. If the stored content of the initial step position setting area is greater than the stored content of the present step position storage area, then the program repeats the program steps d through i until the stored content of the initial step position setting storage area is equalized to the stored content of the present step position storage area. While the program steps d through i are repeatedly executed, the output port 40 successively issues exciting pulses CC(H), 99(H), 33(H) . . . , subsequently to 66(H), to the step motor assembly 3 to excite the b and c phases, c and d phases, d and a, . . . successively for thereby turning the step motor clockwise through successive steps to open the throttle valve 2 through incremental angular intervals. When the execution of the program step i has been completed, the step motor 3-2 has been turned to the step position stored in the initial step position setting area, and the throttle valve 2 is opened to an extent commensurate with the step motor step position stored in the initial step position setting area. At this time, the stored content of the the present step position storage area is equal to the stored content of the initial step position setting storage area.

While the program is executing the foregoing program steps, a control switch for the engine starter is turned on to start the engine 1. After the program step i has been executed, the output from the comparator 26 is read to ascertain whether the comparator output is of a high potential, or the engine 1 is operating by itself without the aid of the starter, and the program waits for the engine 1 to operate by itself (program step j). If the program step j detects when the output from the comparator 26 goes high, that is, the engine 1 operates by itself, the timer 41 is set to a certain period of time, that is, the frequency-division ration for the frequency divider and the preset value for the programmable down counter in the timer 41 are established (program step k). Then, an interrupt is permitted (program step l). The output digital data from the analog-to-digital converter 23, indicative of a position to which the accelerator pedal 19, is depressed is read (program step m), and a target step position corresponding to the accelerator pedal position is found from a look-up table containing accelerator pedal positions and corresponding target step positions (program step n). The look-up table contains target step positions as step motor step numbers with the fully closed positions of the throttle valve 2 being used as a reference. The target step position thus obtained corresponding to the output digital data from the analog-to-digital converter 23 is stored in the target step position starge area (program step o).

The program step o is followed by other program steps that are not directly related to the present invention, and then the program goes back to the program step m to repeat the program steps m through o. When the accelerator pedal position is changed while the program goes through the loop m through o and back to m, the stored content of the target step position storage area is renewed.

The timer 41 which is set to the period of time in the program step k counts time by frequency-dividing the clock signal in the microcomputer 35 and counting down the frequency-divided clock signal, and issues an interrupt signal each time the period of time set by the timer elapses while the program is in the loop m through o and back to m. The program is then caused by the interrupt signal to execute an interrupt routine or accelerator-controlled routine as shown in FIG. 5 at the time that any command from the ROM 38 that is being executed when the interrupt signal occurs is completed.

As shown in FIG. 5, the accelerator-controlled routine is started by comparing the stored content of the target step position storage area with the stored content of the present step position storage area (program step p). If the stored content of the target step position storage area, which corresponds to the accelerator pedal position when the accelerator pedal 19 is depressed, is greater than the stored content of the present step position storage area, then the stored content of the excitation pattern storage area is rotated left 9 bit (program step 1). The left rotation causes the stored excitation pattern to change from 33(H) to 66(H), from 66(H), to CC(H), from CC(H) to 99(H), or from 99(H) to 33(H). The excitation pattern immediately prior to the pattern change is the excitation pattern immediately prior to generation of the interrupt signal. The excitation pattern rotated left by one bit in the program step q is then outputs through the output port 40 (program step r) to the step motor assembly 3, which is now turned clockwise through 1 step. As a result, the throttle valve 2 is angularly moved in an opening direction through an angular interval corresponding to the one step angular displacement of the step motor rotor from the throttle valve opening immediately prior to generation of the interrupt signal. The excitation pattern rotated left by one bit in the program step q is thereafter stored in the excitation pattern storage area (program step s), and the stored content of the present step position storage area is incremented by 1 (program step t). In response to this increment, the stored content of the present step position storage area is renewed into data corresponding to the new opening of the throttle valve 2 achieved by the program step r. The program step t is followed by a program step u in which an interrupt is permitted to allow the program to return to the loop m, n, o . . . shown in FIG. 4 that was executed prior to generation of the interrupt signal.

If the stored content of the target step position storage area is smaller than the stored content of the current step position storage area in the program step p, then the program goes to a program step w in which the stored content of the excitation pattern storage area is rotated right by w bit (program step 1). The right rotation causes the stored excitation pattern to change from 33(H) to 99(H), from 99(H) to CC(H), from CC(H) to 66(H), or from 66(H) to 33(H). The excitation pattern immediately prior to the pattern change is the excitation pattern immediately prior to generation of the interrupt signal. The excitation pattern rotated right by one bit in the program step w is then output through the output port 40 (program step x) to the step motor assembly 3, which is now turned counterclockwise through 1 step. As a result, the throttle valve 2 is angularly moved in a closing direction through an angular interval corresponding to the one step angular displacement of the step motor rotor from the throttle valve opening immediately prior to generation of the interrupt signal. The excitation pattern rotated right by one bit in the program step w is thereafter stored in the excitation pattern storage area (program step y), and the stored content of the present step position storage area is decremented by 1 (program step z). In response to this decrement, the stored content of the present step position storage area is renewed into data corresponding to the new opening of the throttle valve 2 achieved by the program step x. The program step z is followed by the program step u in which an interrupt is permitted to allow the program to return to the loop m, n, o . . . shown in FIG. 4 that was executed prior to generation of the interrupt signal.

If the stored content of the target step position storage area is equal to the stored content of the present step position storage area in the program step p, then the program step u is executed following the program step p to allow the program to return to the loop m, n, o . . . shown in FIG. 4 that was executed prior to generation of the interrupt signal. Each time an interrupt signal is issued, the interrupt routine or accelerator-controlled routine is executed to control the step motor assembly 3 to reach the stored content of the target step position storage area for thereby controlling the throttle valve 2 to be opened to an angular position commensurate with the step position stored in the target step position storage area. The stored content of the target step position storage area with which the present step position is compared in the program step p is renewed each time the program step o is executed. Consequently, the opening of the throttle valve 2 is controlled in response to the position to which the accelerator pedal 19 is depressed.

Figure 6:
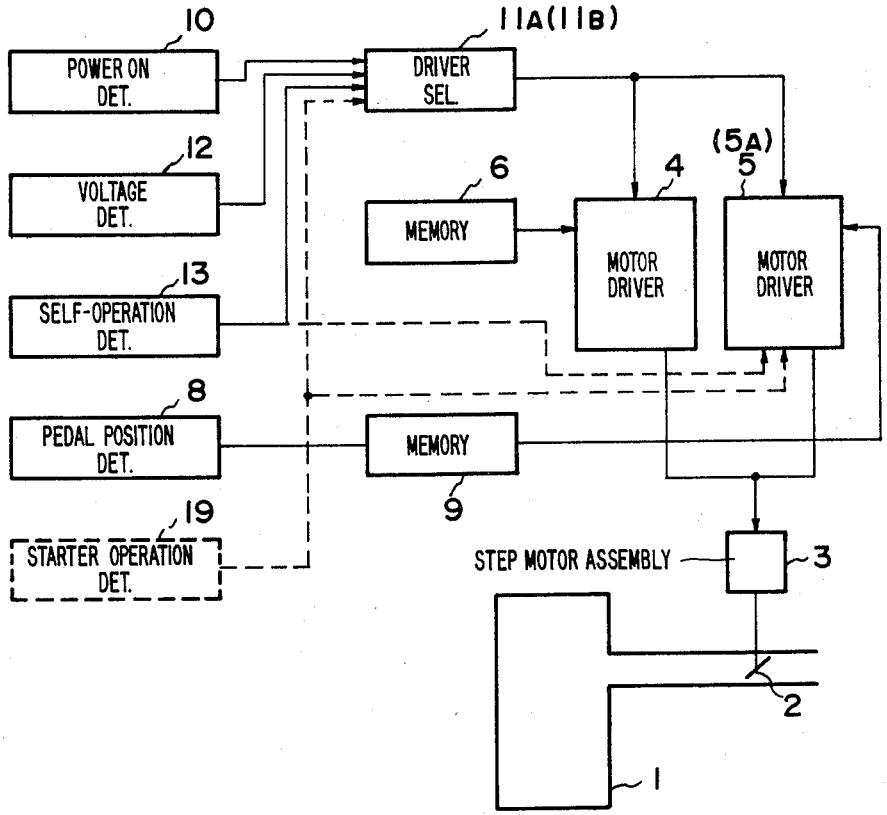
FIG. 6 is a block diagram of fuel supply control systems according to second and fourth embodiments of the present invention.

FIG. 6 illustrates a fuel supply control system according to a second embodiment of the present invention for controlling fuel supply to a spark ignition engine 1 such as a gasoline engine.

The fuel supply control system of the second embodiment differs from the fuel supply control system of the first embodiment in that a voltage detector 12 is added for detecting the voltage value for the main power supply voltage and for determining whether the detected voltage is lower than, or equal to or higher than a preset voltage value. An output from the voltage detector 12 is applied to a driver selector 11A which, when the main power supply voltage is lower than the preset voltage value, will select the motor driver 4 to open the throttle valve 2 to a prescribed extent and then select the motor driver 5 to control the throttle valve 2 dependent on the position to which the accelerator pedal 19 is depressed. When the main power supply voltage is higher than the preset voltage value, the selector 11A immediately selects the motor driver 5 to control the throttle valve 2 dependent on the accelerator pedal position, while omitting the process of opening the throttle valve 2 to the prescribed extent.

Figure 7:
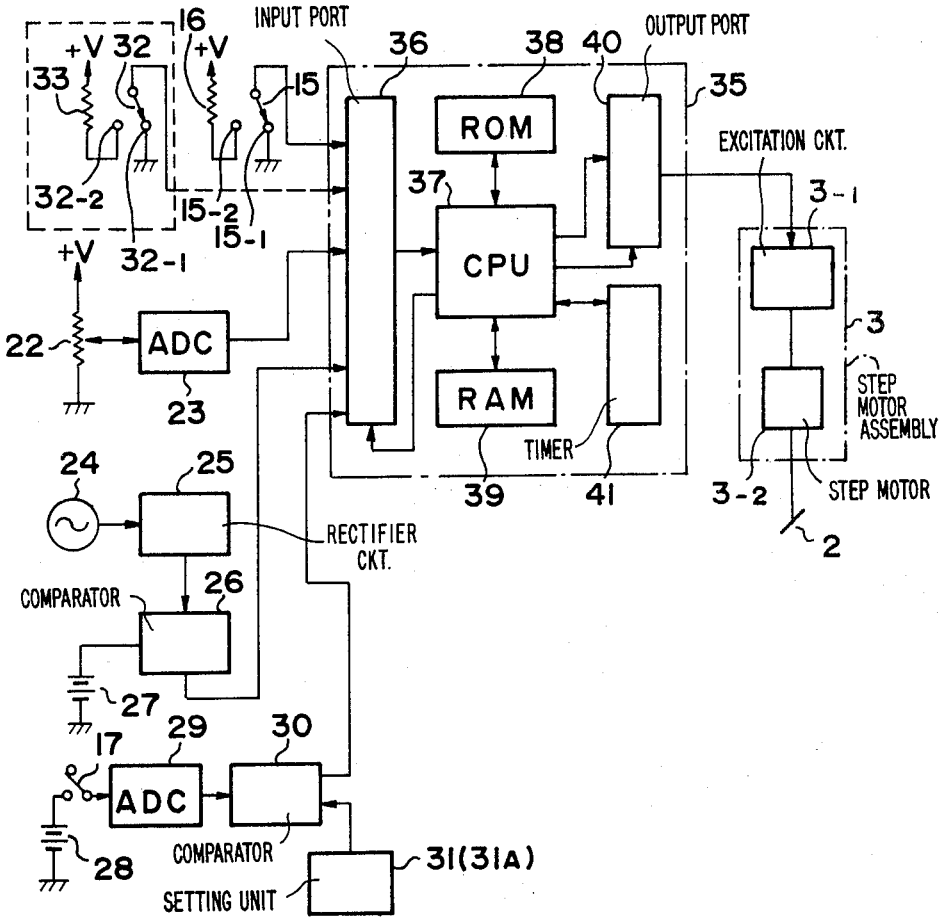
FIG. 7 is a block diagram showing a microcomputer and input and output devices which implement the fuel supply control systems of the second and third embodiments.

FIG. 7 is a block diagram showing a microcomputer and input and output devices by which the fuel supply control system shown in FIG. 6 is implemented. The arrangement of FIG. 7 is different from that shown in FIG. 2 in that the voltage of a main power supply 28 is supplied via an ignition switch 17 to an analog-to-digital converter 29, and digital output data from the analog-to-digital converter 29 is compared by a comparator 30 with preset data from a setting unit 31, with an output from the comparator 30 being fed to the input port 36. The ignition switch 17 is ganged with the switch 15 as described with reference to the first embodiment. The preset data in the setting unit 31 is selected to include a voltage drop in the main power supply 28 which will be caused by energizing the engine starter. The comparator 30 outputs an output of a high potential when the voltage $V_M$ from the main power supply 28 is equal to or higher than a voltage $V_S$ corresponding to the preset data in the setting unit 31.

Figure 8:
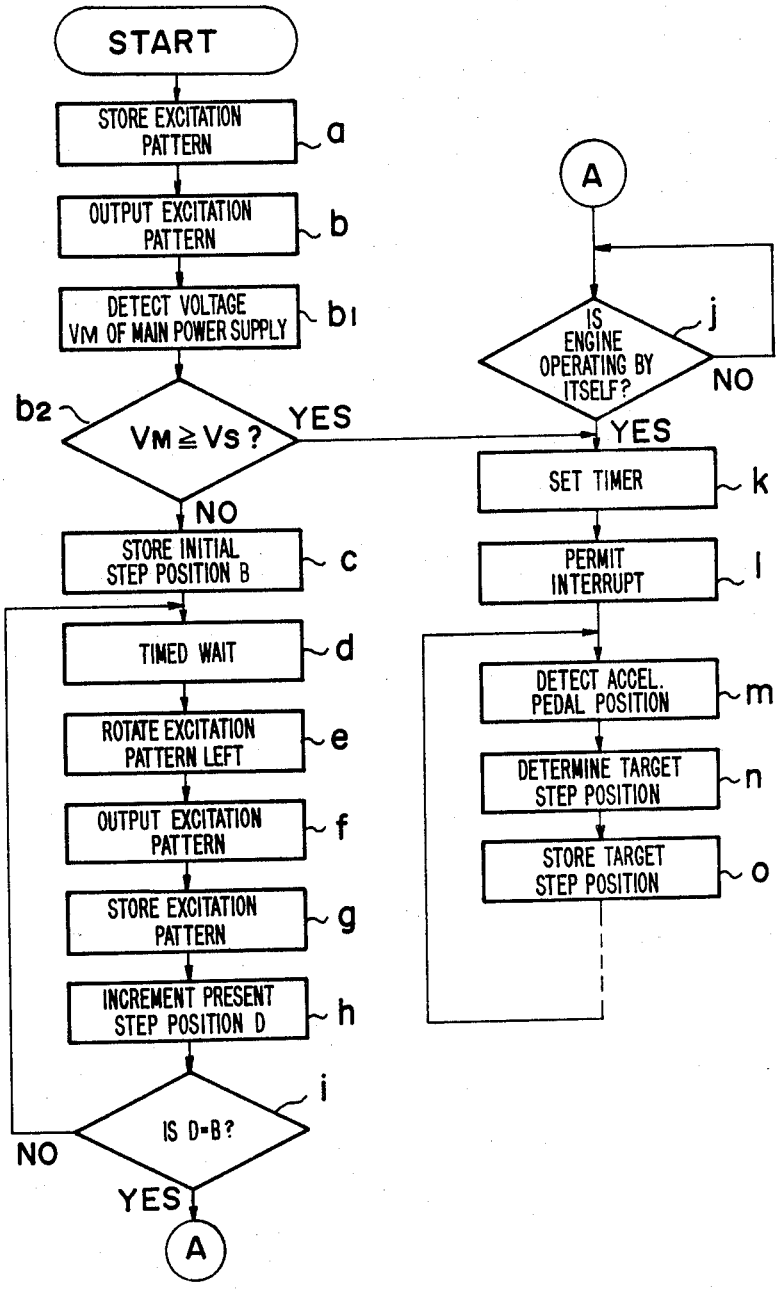
FIG. 8 is a flowchart illustrative of operation of the fuel supply control system according to the second embodiment.

The program stored in the ROM 38 for performing the function of the second embodiment is shown the flowcharts of FIGS. 8 and 5. Operation of the fuel supply control system according to the second embodiment will be described with reference to FIGS. 8 and 5.

When the switch 15 is turned on, the program starts to run so as to execute the program steps a and b, holding the step motor assembly 3 at rest while in an excited condition. After the program step b, an output from the comparator 30 is detected (program step b1). Then, a program step b2 ascertains whether the output from the comparator 30 is of a high potential, or that the voltage $V_M$ of the main power supply 28 is equal to or higher than the preset data in the setting unit 31. If $V_M \geqq V_S$, then the program jumps to the program step k, while omitting the program steps c through j. If $V_M < V_S$, then the program step c is executed. The other program steps are the same as those in the first embodiment. With the second embodiment, after the step motor 3 has been kept at rest in an excited condition, the main power supply voltage $V_M$ is compared with the voltage $V_S$ corresponding to the preset data from the setting unit 31, and if $V_M < V_S$, then the fuel supply control system operates in the same way as that of the fuel supply control system of the first embodiment, and if $V_M \geqq V_S$, then the throttle valve 2 is controlled so as to be operated from the fully closed position dependent on the accelerator pedal position. When $V_M \geqq V_S$, the power supply voltage supplied from the main power supply to the excitation circuit 3-1 is sufficiently high to enable the step motor step position to be controlled in a manner commensurate with the accelerator pedal position.

FIG. 6 also illustrates a fuel supply control system according to a third embodiment of the present invention for controlling fuel supply to a spark ignition engine 1 such as a gasoline engine.

The fuel supply control system of the third embodiment differs from the fuel supply control system of the second embodiment in that a starter operation detector 19 (shown by the broken lines) is added for detecting whether the starter for the engine 1 is in operation or not. When application of a power supply voltage is detected, a driver selector 11B selects the motor driver 4 to open the throttle valve 2 to a certain extent, and thereafter the main power supply voltage is detected when the starter is detected as starting its operation. If the main power supply voltage $V_M$ is equal to or higher than a preset voltage value $V_S'$, the driver selector 11B selects a motor driver 5A to control the opening of the throttle valve 2 dependent on the accelerator pedal position. If $V_M > V_S'$, then the driver selector 11B selects the motor driver 5A when the engine 1 is detected as operating by itself, entering the control mode in which the opening of the throttle valve 2 is controlled dependent on the accelerator pedal position. While the throttle valve 2 is being controlled in its opening, the motor driver 5A detects the condition in which the engine 1 operates by itself in each step of the step motor 3. If the engine 1 is not operating by itself, then the throttle valve 2 is driven to an idling opening, and the motor driver 4 is selected again for the control of opening of the throttle valve 2.

FIG. 7 also shows a microcomputer and input and output devices which implement the fuel supply control system according to the third embodiment. A portion enclosed by the dotted line in FIG. 7 corresponds to the starter operation detector 19 illustrated in FIG. 6.

The portion enclosed by the dotted line in FIG. 7 is an addition to the fuel supply control system according to the second embodiment. A switch 32 is switchable in coaction with a control switch for the starter for the engine 1 and has an off-terminal 32-1 and an on-terminal 32-2. The off-terminal 32-1 corresponds to an off-terminal of the starter control switch and is grounded. The on-terminal 32-2 corresponds to an on-terminal of the starter control switch and is supplied with the voltage +V through a pull-up resistor 33. The switch 32 has a movable contact connected to the input port 36. When the starter control switch is turned on, the stater is energized so as to start the engine 1 and the switch 32 is turned on to supply a high-potential output to the input port 36. When the starter control switch remains turned off or is brought into a turn-off position, the starter is not energized, and the switch 32 is turned off and issues a low-potential output. Accordingly, whether the starter is energized or not can be detected by the output from the switch 32.

Figure 9:
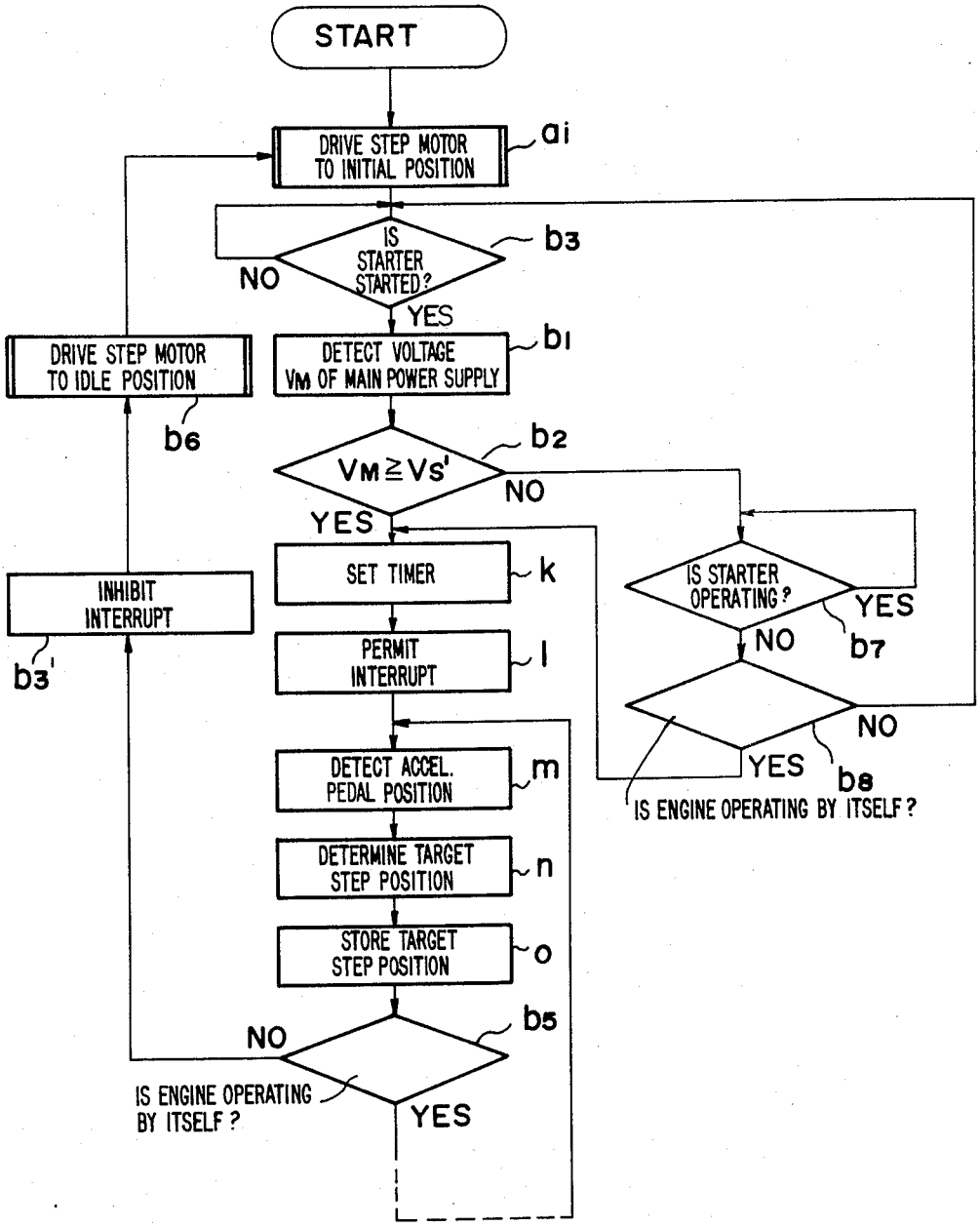
FIG. 9 is a flowchart illustrative of operation of the fuel supply control system according to the third embodiment.

The program stored in the ROM 38 for performing the function of the third embodiment is shown the flowcharts of FIGS. 9 and 5. Operation of the fuel supply control system according to the third embodiment will be described with reference to FIGS. 9 and 5.

When the switch 15 is turned on, the program starts to run so as to execute the program steps a through i of the first embodiment (program step ai shown in FIG. 9) to turn the step motor to the step position stored in the initial step position setting storage area for thereby actuating the throttle valve 2 to an opening corresponding to the stored content of the initial step position setting storage area. The program step ai is followed by a program step b3 which determines whether the starter is started or not, that is, the output from the switch 32 is of a high potential, and waits for the output from the switch 32 to reach the high potential. If the switch 32 is turned on, then the program step b2 determines whether the output from the comparator 30 is of a high potential, that is, whether the voltage $V_M$ from the main power supply 28 is equal to or higher than the voltage value $V_S'$ corresponding to the preset data from a setting unit 31A. The voltage value $V_S'$ may be lower than the voltage value $V_S$ in the second embodiment for reason that since the voltage from the main power supply 28 is detected after the starter has been started, it is not necessary to include any voltage drop in the main power supply produced at the time the starter is energized.

If $V_M \geqq V_S'$ in the program step b2, the timer 41 is set to a certain period of time (program step k). The program steps i through o are the same as those in the first and second embodiments. The program step o is followed by a program step b5 which determines whether the engine 1 is operating by itself, that is, whether the output from the comparator 26 is high in potential. If the output from the comparator 26 is high, then the program goes through other program steps not directly related to the present invention, and then returns to the program step m. The timer 41 set in the program step k counts time and outputs an interrupt signal each time the preset time has elapsed. Each time the interrupt signal is output, the accelerator-controlled routine shown in FIG. 5 is executed. Accordingly, the throttle valve 2 is controlled by the step motor assembly 3 to provide an opening corresponding to the accelerator pedal position in the same manner as that of the first embodiment.

If the $V_M < V_S'$ in the program step b2, a program step b7 determines whether the starter is operating or the output from the switch 32 is of a high potential and waits for the starter to be stopped in operation. If the output from the switch 32 becomes low in the program step b7, then the program goes to a program step b8 which ascertains whether the engine 1 is operating by itself. If the engine 1 is operating by itself, then the program executes the program step k, and if not, then the program goes back to the program step b3 to wait for the stater to be started. When the program goes through the loop b7 and b8, the throttle valve 2 will be controlled dependent on the accelerator pedal position after it has been confirmed that the engine 1 is operating by itself.

If the program step b5 detects that the engine 1 is not operating by itself, or the output from the comparator 26 is low, then the interrupt is inhibited in a program step b3'. Thereafter, program steps similar to the program steps d through i (FIG. 8) are executed (program step b6) to drive the step motor assembly 3 stepwise to an idling step position stored in an idling step position storage area in the RAM 39 (the idling step position has been stored in the idling step position storage area at the time of setting initial step positions). Therefore, the throttle valve 2 is closed to an idling opening. Then, the program goes back to the program step c in the program step ai. The program step corresponding to the program step e in the program step b6 rotates the exciting pattern right by one bit, and the program step corresponding to the program step h in the program step b6 decrements the stored content of the current step position storage area by 1. Accordingly, when the engine 1 does not operate by itself for some reasons while the throttle valve 2 is controlled dependent on the accelerator pedal position, the throttle valve 2 returns to the idling opening. From the idling opening, the throttle valve 2 is driven stepwise to the step position stored in the initial step position setting storage area, and the program step b3 and the following program steps are repeated.

The first through third embodiments of the invention have been shown and described as being incorporated in the spark ignition engine in which an amount of fuel to be supplied to the engine cylinders is controlled by the throttle valve 2. Where the present invention is applied to diesel engines, the control lever of a fuel injector may driven by the step motor 3.

With the arrangement of the present invention, the step motor is driven to and stopped in an initial step position setting at the time the engine is started. The step motor is capable of producing a larger torque after it is stopped than when it is being rotated at a certain speed. The step motor can reliably be driven even when the main power supply voltage drops due to energization of the engine starter upon starting of the engine. Therefore, the engine can be started reliably.

Although certain preferred embodiments have been shown and described, it should be understood that many changes and modifications may be made therein without departing from the scope of the appended claims.

What is claimed is:

1. A fuel supply control system for controlling an amount of fuel supplied to an internal combustion engine by driving a step motor operatively coupled to fuel supply control means of the engine, comprising:

(a) power-on detector means for detecting when a main power supply voltage is applied;

(b) engine self-operation detector means for detecting when the engine is operating by itself;

(c) an accelerator-pedal position detector means for detecting a position to which an accelerator pedal is depressed;

(d) initial step position setting memory means for storing an initial preset step position of the step motor;

(e) target step position memory means for storing a target step position of the step motor corresponding to said position to which the accelerator pedal is depressed;

(f) first step motor driver means for driving the step motor stepwise to the initial preset step position stred in said initial step position setting memory means;

(g) second step motor driver means for driving the step motor stepwise to the target step position stored in said target step position memory means; and (h) selector means for selecting said first step motor driver means in response to a signal from said power-on detector means and for selecting said second step motor driver means in response to a signal from said engine self-operation detector means.

2. A fuel supply control system according to claim 1, further including voltage detector means for detecting the value of the main power supply voltage and for enabling said selector means to select said second step motor driver means when the detected value of the main power supply voltage is equal to or higher than a preset value.

3. A fuel supply control system according to claim 2, further including starter operation detector means for detecting operation of a starter for starting the engine, said voltage detector means detecting the value of the main power supply voltage after said starter operation detector means has detected operation of the starter.

* * * * *